US006983891B1

(12) United States Patent
Stanioriski et al.

(10) Patent No.: US 6,983,891 B1
(45) Date of Patent: Jan. 10, 2006

(54) TRACKHOE ANTI-SKID DEVICE

(76) Inventors: Paul J. Stanioriski, 1130 Harding Dr., Havertown, PA (US) 19083; Edward Kosakowski, 22 Burke Ave., Conshocken, PA (US) 19428; Juan G. Velasquez, 335 Limpkiln Pike, Glenside, PA (US) 19038

( * ) Notice: Subject to any disclaimer, the term of this patent is extended or adjusted under 35 U.S.C. 154(b) by 0 days.

(21) Appl. No.: 10/773,600

(22) Filed: Feb. 6, 2004

(51) Int. Cl.
*E01B 23/00* (2006.01)

(52) U.S. Cl. ..... 238/14

(58) Field of Classification Search ..... 238/14; 248/228.3, 231.41, 231.9; 404/18, 34, 35, 404/41, 57, 60

See application file for complete search history.

(56) References Cited

U.S. PATENT DOCUMENTS

| | | | | | |
|---|---|---|---|---|---|
| 1,258,466 | A | * | 3/1918 | Robertson | 238/14 |
| 3,357,639 | A | * | 12/1967 | Peterson | 238/14 |
| 3,640,459 | A | | 2/1972 | Preister | |
| 3,749,309 | A | | 7/1973 | Becker | |
| 4,261,510 | A | | 4/1981 | Andrus | |
| 4,265,399 | A | * | 5/1981 | Covington | 238/14 |
| 4,534,508 | A | | 8/1985 | Willner, Jr. | |
| D315,326 | S | | 3/1991 | Pinto | |
| 5,822,918 | A | * | 10/1998 | Helfman et al. | 47/39 |
| 6,520,420 | B1 | | 2/2003 | Singh | |

* cited by examiner

*Primary Examiner*—Mark T. Le

(57) ABSTRACT

A trackhoe anti-skid device for reducing lawn damage having a bottom traction plate a spike connected to the bottom traction plate for frictionally engaging conventional earth. A top traction plate boltable to the bottom traction plate for adjusting the width.

1 Claim, 3 Drawing Sheets

TRACKHOE ANTI-SKID DEVICE

BACKGROUND OF THE INVENTION

1. Field of the Invention

The present embodiment of the invention relates to a trackhoe anti-skid device for use in connection with traction devices. The trackhoe anti-skid device has particular utility in connection with traction devices having adjustable width.

2. Description of the Prior Art

Trackhoe anti-skid devices are desirable for increasing the traction in soft soil of track-hoes. A need was felt for an anti-skid device that had adjustable width and having deep spikes which reduces the amount of lawn marring when the track hoe frictionally grabs the anti-skid device.

The use of traction devices is known in the prior art. For example, U.S. Pat. No. 6,520,420 to Singh discloses a vehicle anti-slip device for providing traction for a wheel positioned on a relatively slippery surface. The vehicle anti-slip device includes a frame having a first wall, a second wall, a third wall, and a fourth wall integrally coupled together such that the frame generally has a rectangular shape. The first and second walls are located opposite of each other. The frame has a top edge and a bottom edge. The bottom edge of the frame has a plurality of gripping members attached thereto. However, the Singh '420 patent does not have adjustable width, and does not have a smooth undersurface with a deep traction spike.

Similarly, U.S. Pat. No. 4,534,508 to Willner, Jr. discloses an anti-skid device for use with a vehicle ground-engaging wheel, and which includes a traction pad for wedging under a vehicle wheel to allow traction thereon upon rotation of a vehicle wheel. A retractor apparatus is adapted to be mounted on the bumper of the vehicle, and it includes a housing in which is rotatably mounted a cable and return spring reel. A cable is coiled around the reel, and it extends through an opening in the housing and is adapted to be attached to a handle on the pad. After the vehicle has moved over the pad and forward a distance equal to the length of the cable, a jerk is imposed on the cable by the forwardly moving vehicle which releases a spring loaded retainer pin that holds the reel in a wound-up position during movement of the wheel over the pad, and permits the reel to move in a reverse direction to retract the cable and move the pad to a position adjacent the retractor apparatus. However, the Willner, Jr. '508 patent does not have adjustable width, and does not have a smooth undersurface with a deep traction spike.

Further, U.S. Pat. No. 4,261,510 to Andrus discloses a vehicle wheel traction device is disclosed for improving the traction of vehicle wheels, particularly for use with an automotive vehicle rendered immobile in snow or sand. A plate is provided with transverse T-shaped gripping members affixed to the plate on each surface for the entire width of the plate. Accordingly, positive traction is provided to both the vehicle wheel and the soft or slippery material, such as snow, sand, mud, or ice in which the wheel has become embedded. The invention is easily handled and used, particularly in emergency situations, and is durable under repeated conditions of hard use. Each T-shaped transverse bar constituting the gripping means is mounted preferably at an angle of about 25.degree. for presenting a positive gripping surface to enable the wheel to travel along the length of the traction device. Furthermore, the transverse bars provide rigidity to the device and are constructed to avoid damage to the tire. The device can be made of any suitable material, such as a lightweight aluminum alloy, high strength molded plastic, and like materials or combinations of materials. However, the Andrus '510 patent does not have adjustable width, and does not have a smooth undersurface with a deep traction spike.

Yet further, U.S. Des. Pat. No. 315,326 to Pinto discloses a vehicle traction mat. However, the Pinto '326 patent does not have adjustable width, and does not have a smooth undersurface with a deep traction spike.

Further still, U.S. Pat. No. 3,640,459 to Preisler discloses a skidproof traction mat for vehicles having pneumatic tires that comprises a flat flexible mat formed with transverse treads on its upper surface. Studs embedded in the mat extend out of the smooth bottom surface of the mat for engagement with a slippery roadway. The mat is rectangular and has long beveled side and end edges to provide an incline on which the wheel can roll. Each stud has a cylindrical body with a reduced diameter cylindrical pin portion extending outwardly axially of one end thereof. Ridges are provided on the bottom surface between rows of protruding stud pin portions to cooperate with the studs in holding the mat in place on the roadway. The ridges elevate the pin portions from the carpet on the floor of the vehicle when the pad is stored thereover and being used as mat thereupon. However, the Preisler '459 patent does not have adjustable width, and does not have a smooth undersurface with a deep traction spike.

Lastly, U.S. Pat. No. 3,749,309 to Becker discloses traction pads that are formed with lugs which bite into ice or snow. The pads are connected together by chains having a length such that the chains are taut when on pad is under a front wheel and the other pad is under the rear wheel of the auto. However, the Becker '309 patent does not have adjustable width, and does not have a smooth undersurface with a deep traction spike.

While the above-described devices fulfill their respective, particular objectives and requirements, the aforementioned patents do not describe a trackhoe anti-skid device that allows traction devices having adjustable width. The Singh '420, Willner, Jr. '508, Andrus '510, Pinto '326, Preisler '459 and Becker '309 patents make no provision for adjustable width, and do not have a smooth undersurface with a deep traction spike to reduce lawn disruption.

Therefore, a need exists for a new and improved trackhoe anti-skid device which can be used for traction devices having adjustable width. In this regard, the present embodiment of the invention substantially fulfills this need.

In this respect, the trackhoe anti-skid device according to the present embodiment of the invention substantially departs from the conventional concepts and designs of the prior art, and in doing so provides an apparatus primarily developed for the purpose of traction devices having adjustable width.

SUMMARY OF THE INVENTION

In view of the foregoing disadvantages inherent in the known types of traction devices now present in the prior art, the present embodiment of the invention provides an improved trackhoe anti-skid device, and overcomes the above-mentioned disadvantages and drawbacks of the prior art. As such, the general purpose of the present embodiment of the invention, which will be described subsequently in greater detail, is to provide a new and improved trackhoe anti-skid device and method which has all the advantages of the prior art mentioned heretofore and many novel features that result in a trackhoe anti-skid device which is not anticipated, rendered obvious, suggested, or even implied by the prior art, either alone or in any combination thereof.

To attain this, the present embodiment of the invention essentially comprises a bottom traction plate a spike connected to the bottom traction plate for frictionally engaging conventional earth. A top traction plate boltable to the bottom traction plate for adjusting the width.

There has thus been outlined, rather broadly, the more important features of the embodiment of the invention in order that the detailed description thereof that follows may be better understood and in order that the present contribution to the art may be better appreciated.

The present embodiment of the invention may also include a bottom side plate and a top side plate. There are, of course, additional features of the present embodiment of the invention that will be described hereinafter and which will form the subject matter of the claims attached.

Numerous objects, features and advantages of the present embodiment of the invention will be readily apparent to those of ordinary skill in the art upon a reading of the following detailed description of presently preferred, but nonetheless illustrative, embodiments of the present embodiment of the invention when taken in conjunction with the accompanying drawings. In this respect, before explaining the current embodiment of the embodiment of the invention in detail, it is to be understood that the embodiment of the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present embodiment of the invention.

It is therefore an object of the present embodiment of the invention to provide a new and improved trackhoe anti-skid device that has all of the advantages of the prior art traction devices and none of the disadvantages.

It is another object of the present embodiment of the invention to provide a new and improved trackhoe anti-skid device that may be easily and efficiently manufactured and marketed.

An even further object of the present embodiment of the invention is to provide a new and improved trackhoe anti-skid device that has a low cost of manufacture with regard to both materials and labor, and which accordingly is then susceptible of low prices of sale to the consuming public, thereby making such trackhoe anti-skid device economically available to the buying public.

Still another object of the present embodiment of the invention is to provide a new trackhoe anti-skid device that provides in the apparatuses and methods of the prior art some of the advantages thereof, while simultaneously overcoming some of the disadvantages normally associated therewith.

Even still another object of the present embodiment of the invention is to provide a trackhoe anti-skid device for traction devices having adjustable width.

Still yet another object of the present embodiment of the invention is to provide a trackhoe anti-skid device for traction devices having a smooth bottom surface with a large spike for minimizing lawn destruction while getting traction.

Lastly, it is an object of the present embodiment of the invention is to provide a trackhoe anti-skid device for traction devices having a side stops to keep the trackhoe from twisting off of the anti-skid device for minimizing lawn destruction.

These together with other objects of the embodiment of the invention, along with the various features of novelty that characterize the embodiment of the invention, are pointed out with particularity in the claims annexed to and forming a part of this disclosure. For a better understanding of the embodiment of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The embodiment of the invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
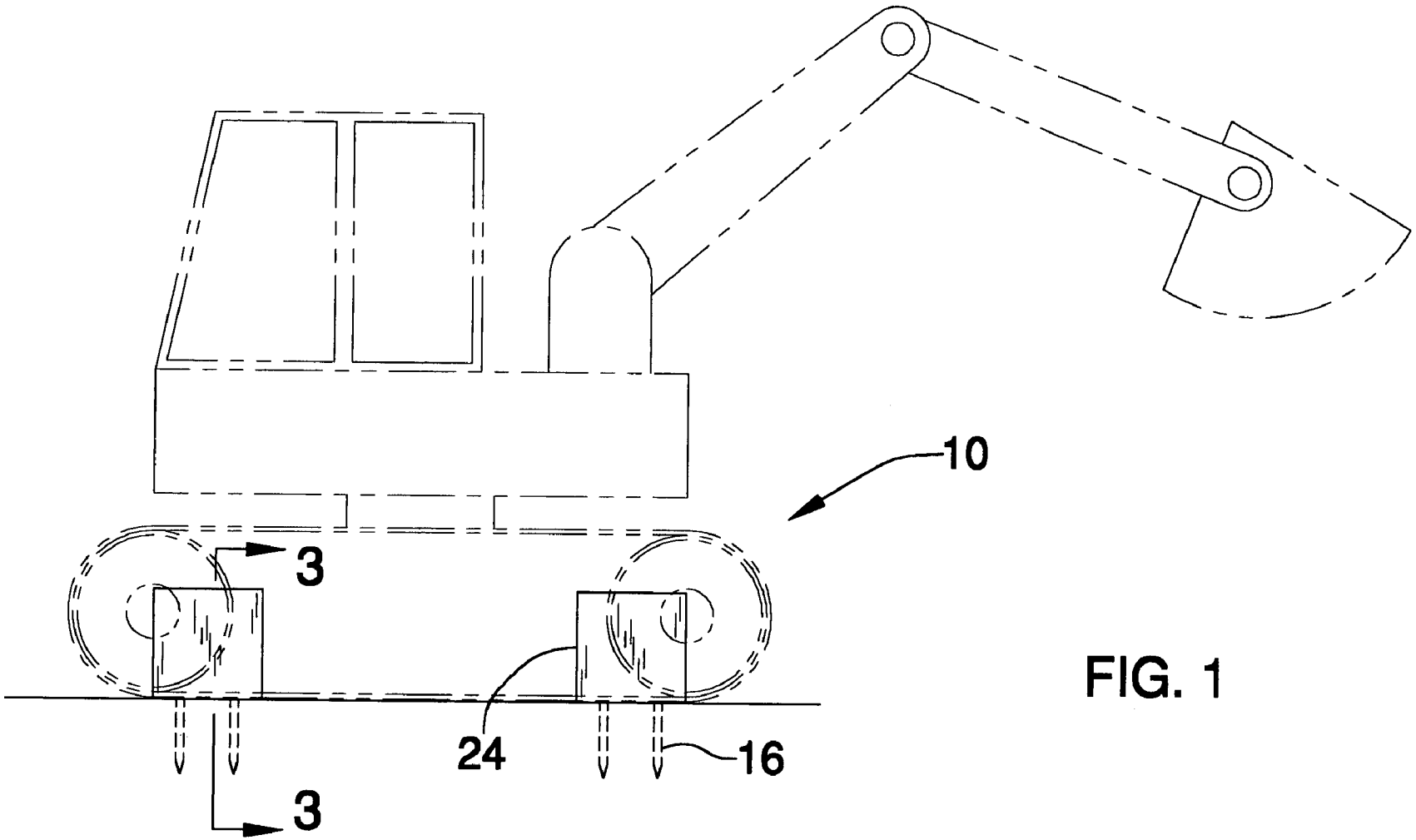
FIG. 1 is a left side view of the preferred embodiment of the trackhoe anti-skid device constructed in accordance with the principles of the present invention.

Referring now to the drawings, and particularly to FIGS. 1–5, a preferred embodiment of the trackhoe anti-skid device of the present invention is shown and generally designated by the reference numeral 10.

In FIG. 1, a new and improved trackhoe anti-skid device 10 of the present invention for traction devices having adjustable width is illustrated and will be described. More particularly, the trackhoe anti-skid device 10 has a bottom traction plate 12 (shown in FIG. 4). A spike 16 is connected to the bottom traction plate 12. The spike 16 is for frictionally engaging conventional earth. A bottom side plate 24 is connected to a bottom traction plate edge 14 (shown in FIG. 4). The bottom side plate 24 is connected to the bottom traction plate 12 at approximately a right angle. The bottom side plate 24 is for restraining sideways slipping of the trackhoe.

Figure 2:
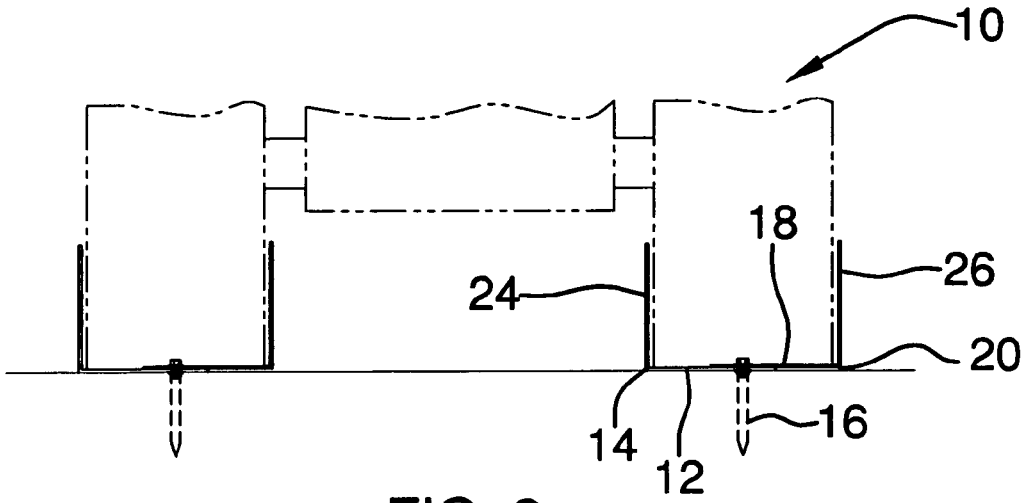
FIG. 2 is a front side view of the trackhoe anti-skid device of the present embodiment of the invention.

In FIG. 2, the trackhoe anti-skid device 10 is illustrated and will be described. More particularly, the trackhoe anti-skid device 10 has the bottom traction plate 12 which has the edge 14. The spike 16 is connected to the bottom traction plate 12. The spike 16 is for frictionally engaging conventional earth. A top traction plate 18 is boltable to the bottom traction plate 12. The top traction plate 18 has an edge 20.

The bottom side plate 24 is connected to the bottom traction plate edge 14. The bottom side plate 24 is connected to the bottom traction plate 12 at approximately the right angle. The bottom side plate 24 is for restraining sideways slipping of the trackhoe. A top side plate 26 is connected to the top traction plate edge 20. The top side plate 26 is connected to the top traction plate 18 at approximately the right angle. The top side plate 26 is for restraining sideways slipping of the trackhoe.

Figure 3:
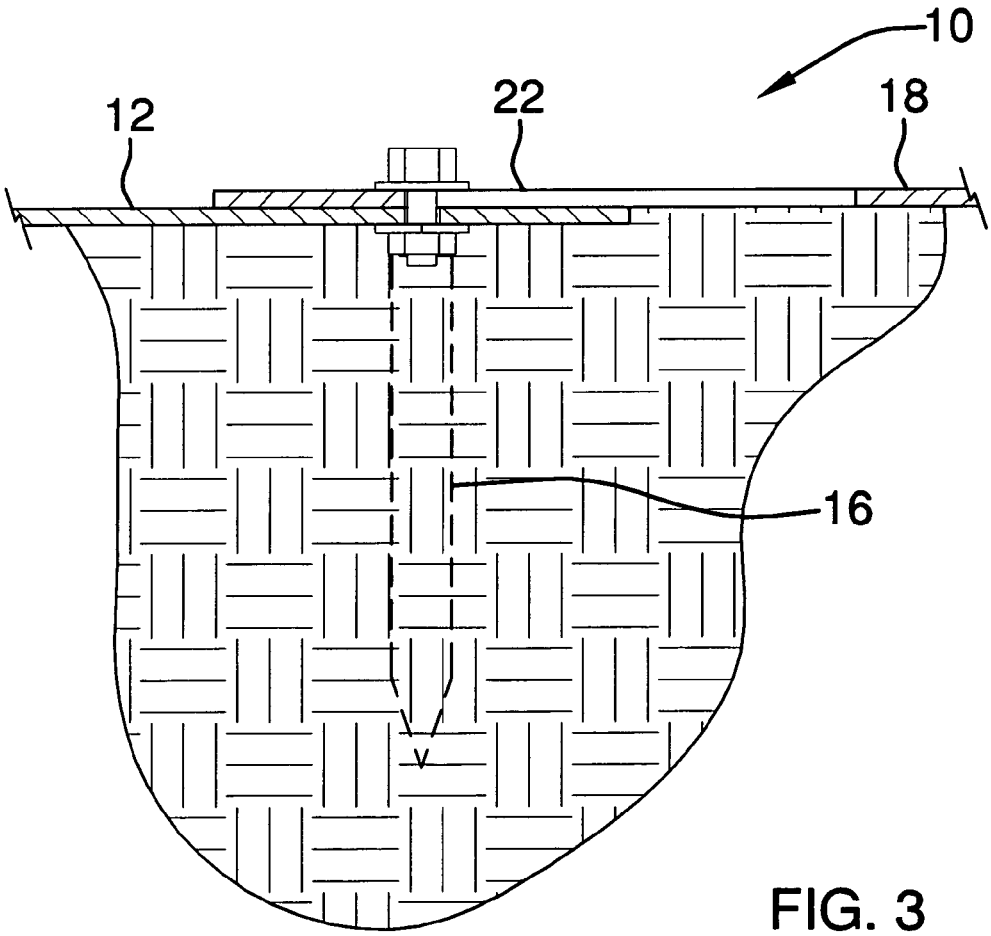
FIG. 3 is a section 3—3 view of FIG. 1 of the trackhoe anti-skid device of the present embodiment of the invention.

In FIG. 3, the trackhoe anti-skid device 10 is illustrated and will be described. More particularly, the trackhoe anti-skid device 10 has the bottom traction plate 12. The spike 16 is connected to the bottom traction plate 12. The spike 16 is for frictionally engaging conventional earth. The top traction plate 18 is boltable to the bottom traction plate 12. The top traction plate 18 has a slot 22 therethrough. The slots 22 are to allow the top traction plate 18 to the bottom traction plate 12 boltable connection to be varied in width.

Figure 4:
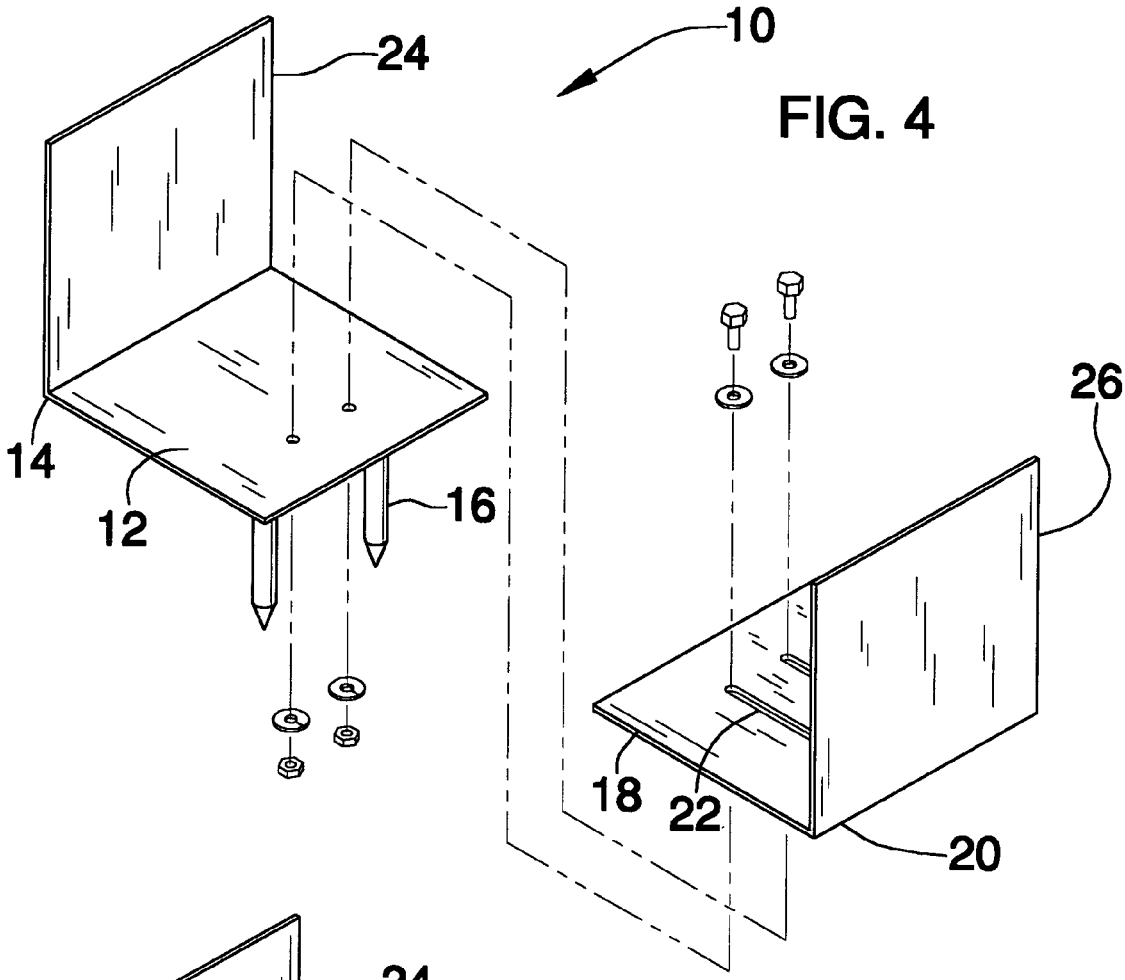
FIG. 4 is an exploded view of the trackhoe anti-skid device of the present embodiment of the invention.

In FIG. 4, the trackhoe anti-skid device 10 is illustrated and will be described. More particularly, the trackhoe anti-skid device 10 has the bottom traction plate 12 which has the edge 14. The bottom traction plate 12 is approximately 12 inches long by 12 inches wide. The bottom traction plate 12 is comprised of steel in the present example, alternative embodiments can be comprised of rubber and plastic. The spike 16 is connected to the bottom traction plate 12. The spike 16 is for frictionally engaging conventional earth. The spike 16 is approximately 8 inches long. The spike 16 is comprised of steel in the present example, alternative embodiments can be comprised of rubber and plastic. The top traction plate 18 is boltable to the bottom traction plate 12. The top traction plate 18 has slots 22 therethrough. The slots 22 are to allow the top traction plate 18 to the bottom traction plate 12 boltable connection to be varied in width. The top traction plate 18 has the edge 20. The top traction plate 18 is approximately 12 inches long by 12 inches wide. The top traction plate 18 is comprised of steel in the present example, alternative embodiments can be comprised of rubber and plastic. The bottom side plate 24 is connected to the bottom traction plate edge 14. The bottom side plate 24 is connected to the bottom traction plate 12 at approximately the right angle. The bottom side plate 24 is for restraining sideways slipping of the trackhoe. The top side plate 26 is connected to the top traction plate edge 20. The top side plate 26 is connected to the top traction plate 18 at approximately the right angle. The top side plate 26 is for restraining sideways slipping of the trackhoe.

Figure 5:
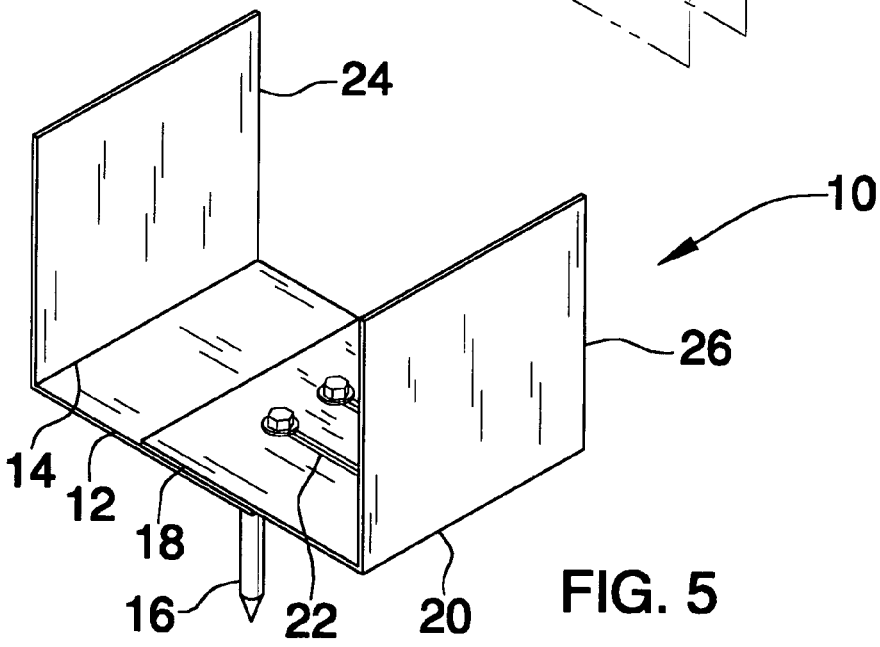
FIG. 5 is a top perspective view of the trackhoe anti-skid device of the present embodiment of the invention.

In FIG. 5, the trackhoe anti-skid device 10 is illustrated and will be described. More particularly, the trackhoe anti-skid device 10 has the bottom traction plate 12 which has the edge 14. The spike 16 is connected to the bottom traction plate 12. The spike 16 is for frictionally engaging conventional earth. The top traction plate 18 is boltable to the bottom traction plate 12. The top traction plate 18 has slots 22 therethrough. The slots 22 are to allow the top traction plate 18 to the bottom traction plate 12 boltable connection to be varied in width. The top traction plate 18 has the edge 20. The bottom side plate 24 is connected to the bottom traction plate edge 14. The bottom side plate 24 is connected to the bottom traction plate 12 at approximately the right angle. The bottom side plate 24 is for restraining sideways slipping of the trackhoe. The top side plate 26 is connected to the top traction plate edge 20. The top side plate 26 is connected to the top traction plate 18 at approximately the right angle. The top side plate 26 is for restraining sideways slipping of the trackhoe.

In use it can now be understood that to use the trackhoe anti-skid device 10 the width of the top traction plate 18 to bottom traction plate 12 would be adjusted to match the tracks of the excavator in question. The first pair of trackhoe anti-skid devices 10 would be positioned on the earth and the trackhoe driven onto them, thereby seating them in place. The process would then be repeated for the next pair.

While a preferred embodiment of the trackhoe anti-skid device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present embodiment of the invention. And although traction devices having adjustable width have been described, it should be appreciated that the trackhoe anti-skid device herein described is also suitable for traction in soft soil where both forward and sideward skid reduction are required.

Therefore, the foregoing is considered as illustrative only of the principles of the embodiment of the invention. Further, since numerous modifications and changes will readily occur to those skilled in the art, it is not desired to limit the embodiment of the invention to the exact construction and operation shown and described, and accordingly, all suitable modifications and equivalents may be resorted to, falling within the scope of the embodiment of the invention.

We claim:

1. A trackhoe anti-skid device comprising:

a bottom traction plate, said bottom traction plate having an edge, said bottom traction plate is approximately 12 inches long by 12 inches wide, said bottom traction plate is comprised of steel;

a spike connected to said bottom traction plate, said spike for frictionally engaging conventional earth, said spike is approximately 8 inches long, said spike is comprised of steel;

a top traction plate boltable to said bottom traction plate, said top traction plate having slots therethrough, said slots to allow said top traction plate to said bottom traction plate boltable connection to be varied in width, said top traction plate having an edge, said top traction plate is approximately 12 inches long by 12 inches wide, said top traction plate is comprised of steel;

a bottom side plate connected to said bottom traction plate edge, said bottom side plate connected to said bottom traction plate at approximately a right angle, said bottom side plate for restraining sideways slipping of said trackhoe; and a top side plate connected to said top traction plate edge, said top side plate connected to said top traction plate at approximately a right angle, said top side plate for restraining sideways slipping of said trackhoe.

* * * * *